US005918854A

United States Patent [19]

Barrash et al.

[11] Patent Number: 5,918,854

[45] Date of Patent: Jul. 6, 1999

[54] POP-UP VALVE CLOSURE FOR A CONTAINER

[75] Inventors: Marshall J. Barrash, Atlanta, Ga.; Gerard M. O'Brien, Hertfordshire, United Kingdom

[73] Assignee: The Coca-Cola Company, Atlanta, Ga.

[21] Appl. No.: 08/636,882

[22] Filed: Apr. 23, 1996

[51] Int. Cl.[6] ..... F16K 35/00

[52] U.S. Cl. ..... 251/116; 251/115

[58] Field of Search ..... 251/114, 115, 251/116

[56] References Cited

U.S. PATENT DOCUMENTS

| | | | |
|---|---|---|---|
| 479,217 | 7/1892 | Kaplan | 251/115 |
| 1,187,871 | 6/1916 | Thomas | 251/115 |
| 1,308,242 | 7/1919 | Imaizumi . | |
| 1,859,126 | 5/1932 | Boeuf . | |
| 2,162,092 | 6/1939 | Lundgren . | |
| 2,628,004 | 2/1953 | Schlicksupp . | |
| 3,095,128 | 6/1963 | Wonso . | |
| 3,221,952 | 12/1965 | DeSee . | |
| 3,511,420 | 5/1970 | Kessler . | |
| 3,927,834 | 12/1975 | Tada | 251/114 |
| 4,179,052 | 12/1979 | Abbott . | |
| 4,925,040 | 5/1990 | Wang . | |
| 5,090,600 | 2/1992 | Clark . | |
| 5,230,447 | 7/1993 | Kirk . | |
| 5,282,541 | 2/1994 | Chen . | |

FOREIGN PATENT DOCUMENTS

| | | |
|---|---|---|
| 596827 | 11/1925 | France . |
| 2721860 | 11/1978 | Germany . |

*Primary Examiner*—A. Michael Chambers
*Attorney, Agent, or Firm*—Birch, Stewart, Kolasch & Birch, LLP

[57] ABSTRACT

A pop-up valve closure for a container has a cap with a well defined therein. A valve with a valve sleeve is movably mounted in this well. The valve is movable between a closed position and a popped-up open position. An actuator can lock and unlock the valve in order to permit opening and closing of the valve. When the actuator unlocks the valve, a spring or other device can automatically move the valve from the closed position to the open position. This unlocking can be carried out with finger pressure applied to a tilting button of the actuator.

29 Claims, 4 Drawing Sheets

14

38
32
30
40
56
34
36

32
34
30
64

11
22
28
15
26
50
66
48
42
46
44

56
28
22
34
15
26
54
52
56
13
42
34
58
66
48
50
14

22
34
28
15
56
40
38
26
54
32
30
22
66
13
48

POP-UP VALVE CLOSURE FOR A CONTAINER

BACKGROUND OF THE INVENTION

1. Field of the Invention

The present invention relates to a pop-up valve closure for a container having a cap with a well, a pop-up valve and an actuator for cooperating with a spring to automatically open the valve.

2. Description of the Background Art

Various closure means are known for different containers. In particular, for conventional can end assemblies, the "ring-pull" or "press-down-stay-on-tab" closures are known. These closures, however, have the drawback in that they are not resealable. Moreover, the tabs can be difficult to open and the sharp edges around the opening can cut a consumer's lips or fingers. Moreover, there is a desire to provide an easier means by which a consumer can drink from the container.

SUMMARY OF THE INVENTION

Accordingly, it is a primary object of the present invention to provide an improved pop-up valve closure for a container which is resealable.

Another object of the present invention is to provide a pop-up valve closure which can automatically open.

Yet another object of the present invention is to provide a pop-up valve closure which is easy to use and simple to manufacture.

Still yet another object of the present invention is to provide a pop-up valve closure which avoids sharp edges around the discharge opening whereby consumer safety can be enhanced.

It is a further object of the present invention to provide a pop-up valve closure which provides a drinking spout feature for ease of beverage consumption.

These and other objects of the present invention are fulfilled by a pop-up valve closure for a container which has a cap having a well defined therein. A valve with a valve sleeve is movably mounted in the well of the cap. This valve can move between a closed position and a popped-up open position. Actuation means are provided for locking and unlocking the valve in the closed position. Opening means will automatically move the valve from the closed position to the popped-up open position in response to a user's finger depressing the actuation means to unlock the valve.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
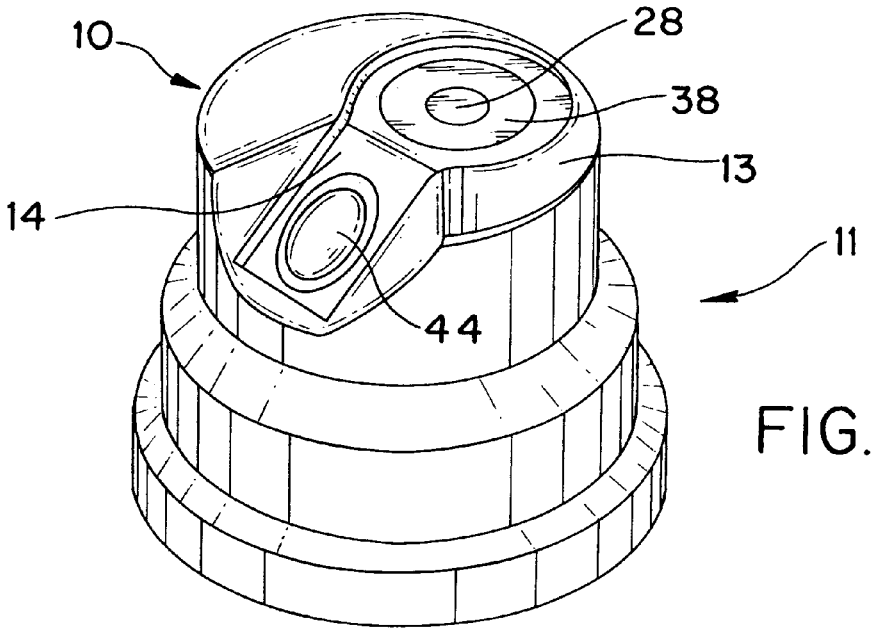
FIG. 1 is a perspective view of the pop-up valve closure of the present invention.
Figure 2:
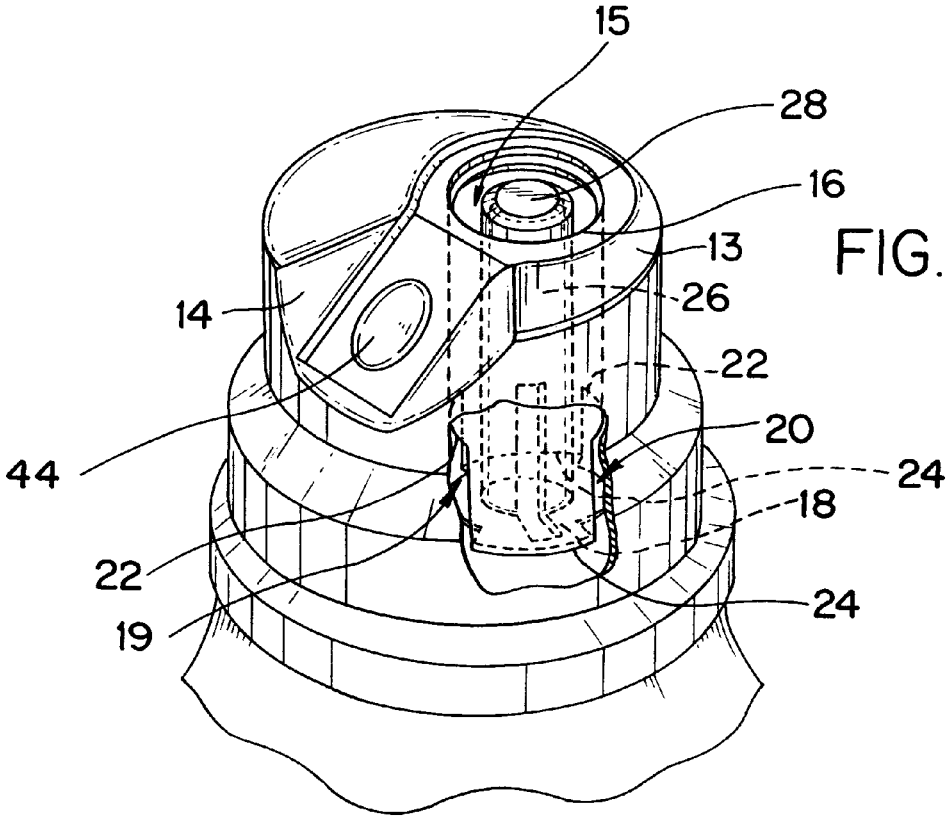
FIG. 2 is a sectional perspective view of the pop-up valve closure of the present invention mounted on a container.

Referring in detail to the drawings and with particular reference to FIG. 1, a pop-up valve closure 10 of the present invention is shown. This pop-up valve closure 10 includes a cap 11 mountable on a container 12 such as a beverage bottle or can as seen in FIG. 2. While a beverage bottle has partially been illustrated, it should be appreciated that any type of suitable container can be used with the pop-up valve closure 10 of the present invention. It is also contemplated that fluid, such as a non-carbonated sports drink, will normally be held within the container 12. Of course, any suitable fluid can be stored within the container.

Cap 11 has a top surface 13 and an adjoining inclined surface 14. Within the top surface 13, well 15 is mounted. This well 15 has a generally cylindrical shape with an upper end 16 and a lower end 17. Both the upper and lower ends 16,17 are open such that fluid within container 12 can be dispensed therethrough. At the lower end 17 of well 11 is a cross member 18. This cross member 18 is mounted to the bottom periphery of the well. This bottom periphery of the well is stepped to form openings 19 and 20. While two openings 19 and 20 are shown, it should be appreciated that any number of openings can be provided in the well. Moreover, these openings can extend over any suitable height and/or width of the walls of well 15 and can be spaced from the bottom periphery of the well. In other words, one or more openings could be located in a mid-portion of the well walls.

The bottom periphery of the well is stepped as noted above and has first bottom rim portions 22 and second bottom rim portions 24. The first bottom rim portions 22 are the upper edges of the openings 19, 20 in the well. The second bottom rim portions 24 are spaced further from the upper end 16 of the well 15 than are the first bottom rim portions 22.

As noted above, a cross member 18 is provided at the bottom of the well. This cross member 18 extends between the second bottom rim portions 24. This connection will be discussed in more detail below with reference to FIG. 12. Mounted on this cross member 18 is a centrally disposed pin 26. The upper end of pin 26 forms a closure element 28. Operation of this closure element 28 will be described in more detail below.

Figures 3, 4, 5, 6, 7, 8:
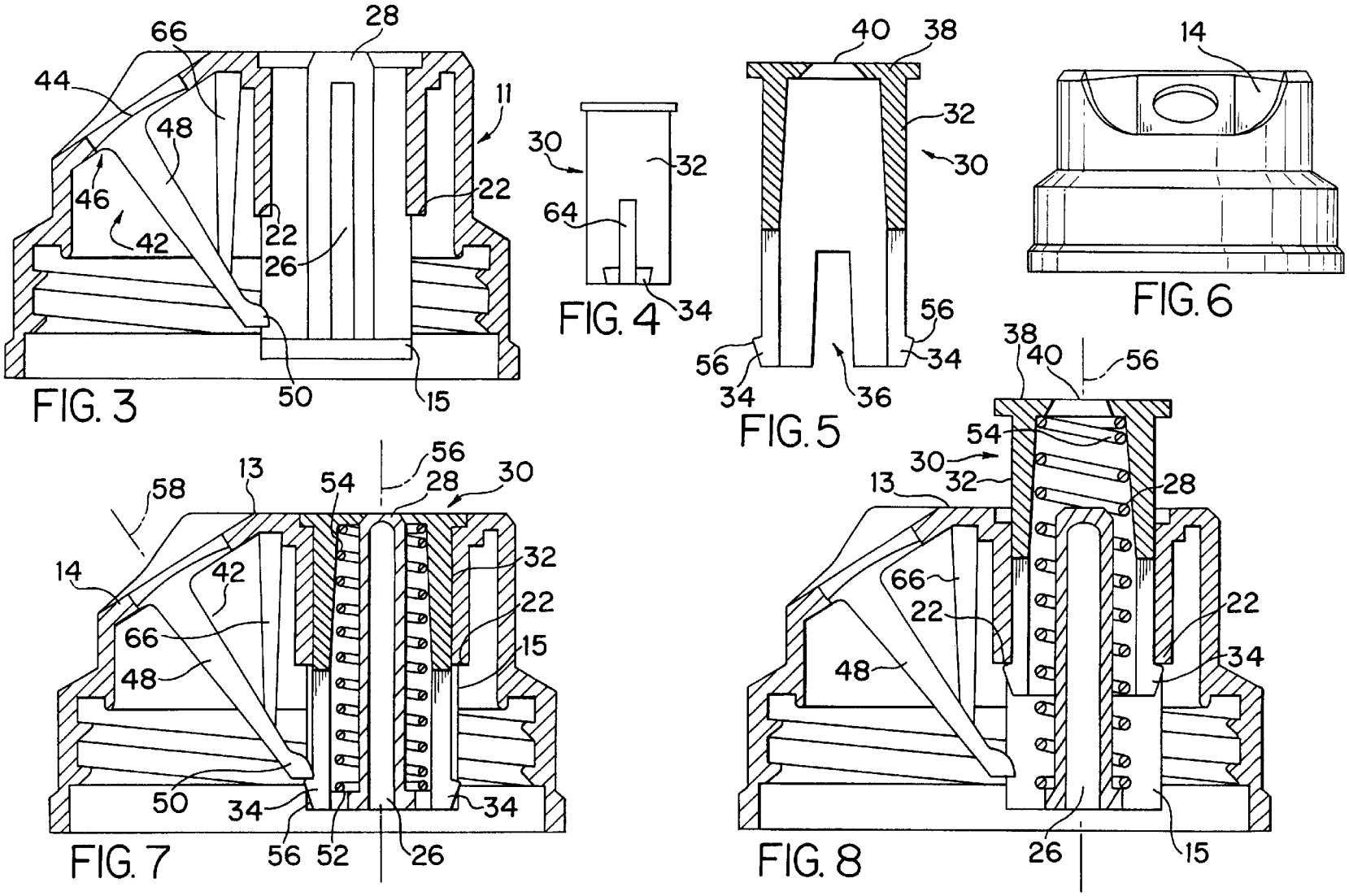
FIG. 3 is a cross-sectional view taken along line III—III of FIG. 2 with certain parts of the pop-up valve closure removed.
FIG. 4 is a right-hand side view of the valve of the present invention.
FIG. 5 is a cross-sectional view taken from the front of the valve of the present invention (to a different scale from FIG. 4)
FIG. 6 is a right-hand side view of the cap of the present invention with the actuator means removed.
FIG. 7 is a cross-sectional view similar to FIG. 3 showing the valve and opening means inserted in the cap and showing the valve in a closed position.
FIG. 8 is a cross-sectional view similar to FIG. 7 showing the valve in an open position.

Turning to FIGS. 4 and 5, a valve 30 mountable in well 15 has a generally cylindrical sleeve 32. It should be noted that these FIGS. 4 and 5 are not to the same scale. At least one set of flanges 34 is provided at the lower end of the valve sleeve 32. In the instant invention as seen in FIG. 5, two flanges 34 are provided on each side of the valve sleeve. It is contemplated that a total of four flanges will be used but, of course, any number of flanges 34 can be provided. Two flared openings 36 are also provided in the sides of the sleeve 32 of the valve 30. Because FIG. 5 is a cross-sectional view, only one of the flared openings 36 is shown. It should be appreciated that in FIG. 4, flared openings would be provided on both the right-hand and left-hand side of the valve 30. Also, in FIG. 4, two side-by-side flanges 34 are shown. It should be noted that in this FIG. 4, the second set of flanges 34 is provided on the rear side of the valve 30.

Between the two flanges 34 in FIG. 4, an opening 64 is provided. This opening will permit compression of the valve during its insertion into well 15. While only two sets of flanges, two openings 64 and two flared openings 36 are provided, it should be contemplated that any number of flanges and openings can be used. In fact, a single flange such as 34 could be used or a continuous annular ring could be provided around the lower end of the valve sleeve 32. Also, an indentation for receiving the end of the actuator means as will be described can be used instead. Instead of using two flared openings 36, any number of openings can be used or no openings at all can be provided. These openings can extend to the lower periphery of the valve sleeve 32 or can be positioned between the ends of the valve sleeve if so desired.

On an upper end of the valve 30 is a lid 38. This generally circular lid 38 has an aperture 40 defined therein. When the valve 30 is in an open position, fluid within the container can be discharged through this aperture 40. The aperture 40 is intersected by the longitudinal axes of both the well 15 and the valve sleeve 32. It is contemplated that a generally circular aperture 40 in the center of the lid 38 of the valve can be used. However, any suitably sized aperture or number of apertures can be used if so desired.

Turning to FIG. 3, the actuator means 42 will now be described. This actuator means 42 includes a button 44 and an inclined strut 46. The button 44 is pivotally mounted on the cap 11. In particular, the button 44 is molded as a part of the cap 11; however, its periphery is thinned. This allows pivoting of button 44. The inclined strut 48 is integrally mounted on the underside of button 44. The longitudinal axis 58 of the strut 48 is offset from the center of button 44. This strut has a bottom 50 which engages at least one set of the flanges 34 as indicated, for example, in FIG. 7. In this engaged position, the actuator means 42 locks the valve 30 in a closed position. To activate the actuation means 42, it is simply necessary for the consumer to press button 44 with his or her finger. This will depress the button 44 and move the offset strut 48 to release the end 50 of strut 48 from the flange 34. The end 50 of the strut 48 will move downwardly and to the left in FIG. 7 away from the valve 30. This action will then cause the valve 30 to automatically pop-up due to the opening means 52.

Integrally formed with cap 11 is a rotation limiter 66. In particular, two legs are provided which extend downwardly from the interior underside of the cap. The lower ends of these legs engage the shank of the inclined strut above its bottom 50. It should be noted that only one leg is shown in FIG. 3, but is contemplated that two side-by-side legs will be used. These legs engage the inclined strut 48 and prevent upward travel thereof beyond a predetermined position.

Operation of the opening means 52 will now be described. In particular, this opening means 52 includes a spring 54 mounted within the valve sleeve 32. This spring 54 urges the valve 30 from the closed position shown in FIG. 7 to the popped-up open position shown in FIG. 8. Opening of the valve 30 is prevented due to engagement of the bottom 50 of the strut with flange 34. The rotation limiter 66 will prevent the spring 54 from pulling the strut 48 upwardly beyond its uppermost predetermined position. This will keep the top of the lid 38 of the valve 30 flush with the top surface 13 of the cap when the valve is in the closed position. The upper end of the spring 54 engages an inner side of the lid 38 of the valve. The lower end of spring 54 rests on the cross member 18 at the lower end of the well.

Both the valve sleeve 32 and spring 54 are mounted in the well 15 of cap 11. The spring 54 surrounds the centrally disposed pin 26. The diameter of the spring is such that it can pass beyond the end of pin 26 which forms the closure element 28. As seen in FIG. 7, this closure element 28 will seal the aperture 40 in the lid 38 of valve 30 in the closed position.

Figure 11:
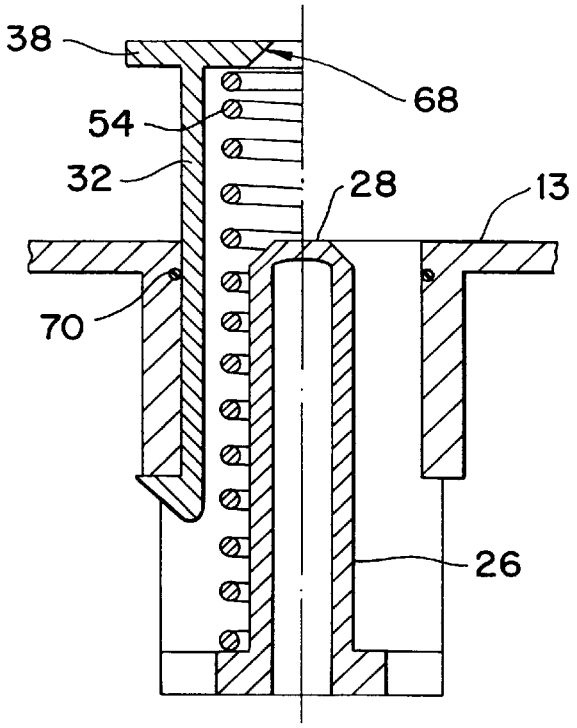
FIG. 11 is a cross-sectional view of a portion of FIG. 7.

Details of the sealing are further shown in FIG. 11. In particular, a sealing member 68 can be provided between the lid 38 of the valve and the chamfered sides of the closure element 28. Also, a sealing member 70 can be provided between the sides of the sleeve 32 and the well 15. In the closed position of the valve 30, these sealing members 68, 70 will prevent fluid from leaking from the container. It should be noted that sealing members 68, 70 do not need to be vacuum seals but merely fluid seals. Of course vacuum seals can be used.

Figure 9:
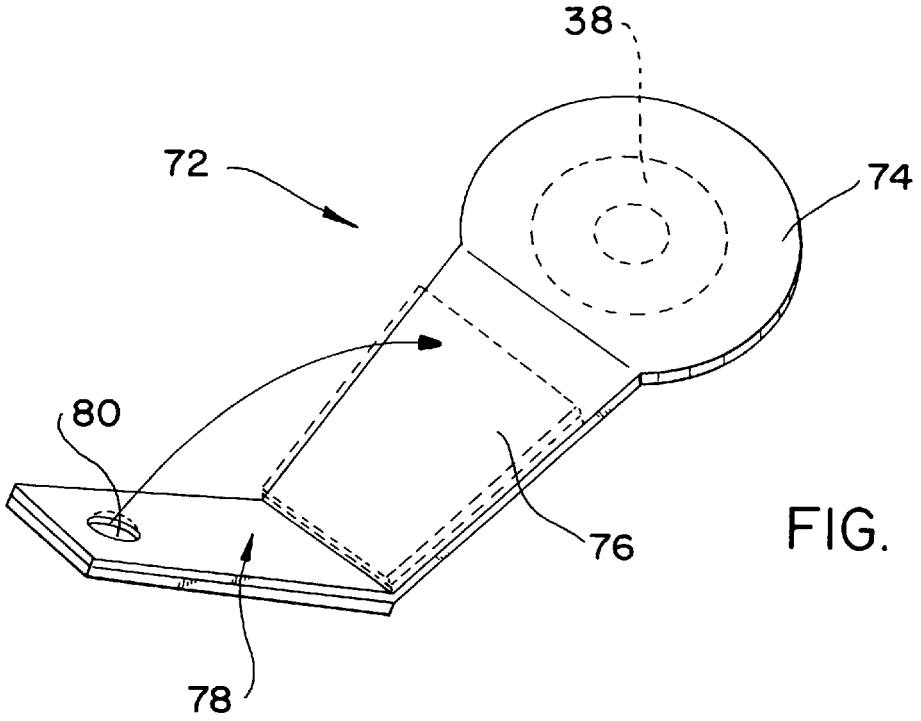
FIG. 9 is a perspective view of tape used in the present invention.
Figure 10:
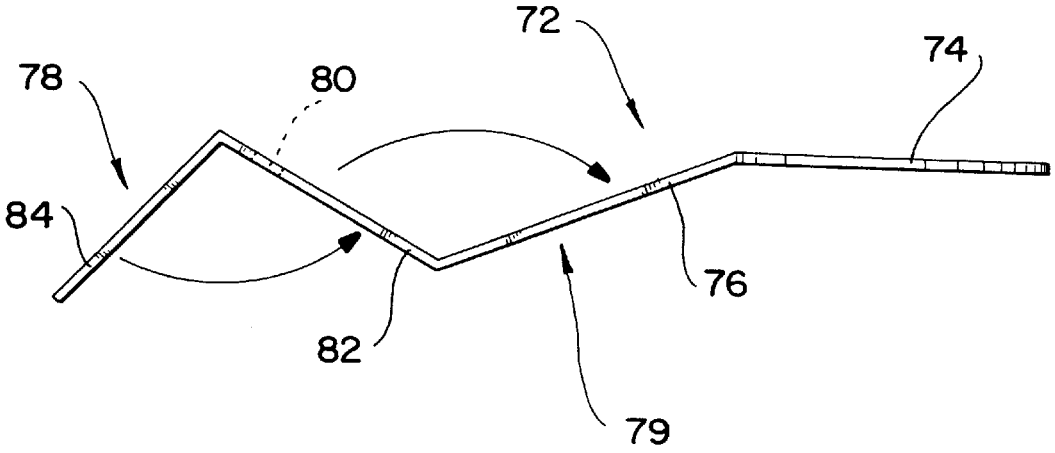
FIG. 10 is a side view of FIG. 9 with the tape unfolded.

As shown in FIG. 9, a vacuum tape system is used to augment the sealing members 68, 70. In particular a metal tape 72, for example, can be used as a seal over the valve 30 and button 44. The head 74 of tape 72 will cover the lid 38 shown in dotted line. The midsection 76 of the tape extends between head 74 and end section 78 of the tape. The tape is folded at the two ends of the midsection 76. Adhesive can be applied to an underside 79 of the tape 72 as indicated in FIG. 10. The head 74 of the tape 72 will be affixed to the top surface 13 and the midsection 76 of the tape 72 will be affixed to the inclined surface 14 of the cap 11. The end section 78 is formed by a first section 82 and a second section 84 of the tape 72 which are folded together.

A hole 80 is provided in the first section 82 so that a small amount of adhesive can leak through to adhere the end section 78 in the folded down position shown in dotted lines in FIG. 9. A consumer can easily grasp this end section 78 and release the small bond formed by the adhesive exposed through hole 80 will easily be broken. The consumer can then easily rip the tape from the container.

This tape 72 provides a tamper evident feature. Also, promotional features such as give-aways can utilize this tape 72. This tape 72 also keeps the drinking surface sanitary.

Figure 12:
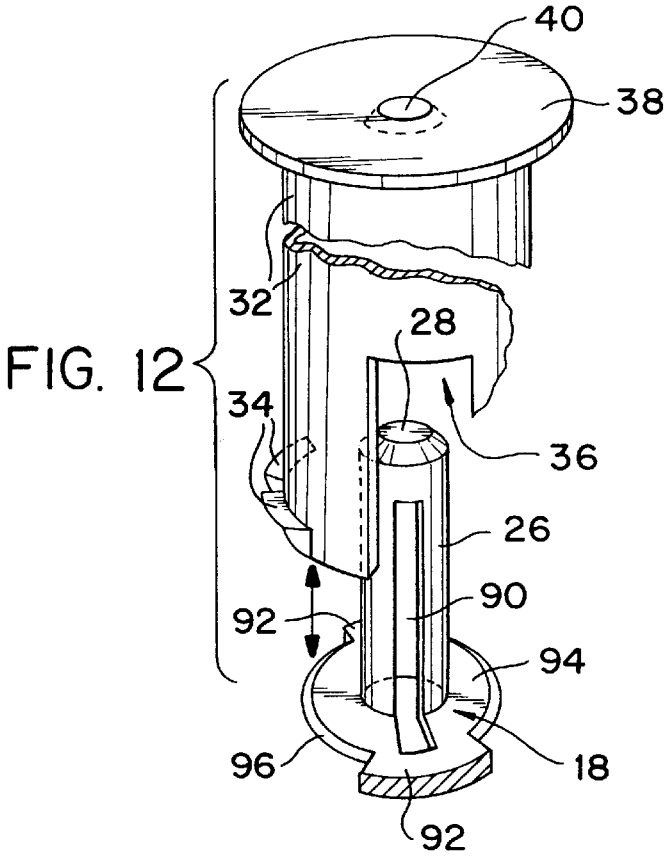
FIG. 12 is a partial exploded view of the valve and pin of the present invention.

After the tape 72 is initially removed, the valve 30 can move to the open position of FIG. 8. Aperture 40 will be opened allowing discharge of fluid from the container. The fluid can easily move through the bottom of the well and the interior of the valve to thereby be discharged from aperture 40. It should be noted that the cross member 18 provides little obstruction to the discharge of fluid from the container 12. As seen in FIG. 12, the cross member 18 and hollow pin 26 can have an opening 90. This opening 90 also aids in the smooth flow of fluid from the container. Also, the openings 19 and 20 in the sides of the well help in the flow of discharging liquid.

In FIG. 12, the two wings 92 and circular midportion 94 form the cross member 18. The midportion 94 has a centrally disposed opening to permit flow of fluid therethrough. The two wings 92 are attached to the first and second bottom rim portions 22, 24 of the bottom periphery of the well. It should be noted that the edges of the midportion 94 of the cross member 18 are chamfered. This will help to center the valve 30 when in the closed position. The recesses formed between the two wings 92 on each side of the midportion 94 will receive the lower edges of the valve 30 in the closed position.

The closure element 28 also has a chamfered surface. In particular, the top of the pin 26 is chamfered to aid in centering of the pin 26 and the valve 30 when the closure element 28 is in the aperture 40.

After opening, the valve 30 can easily be pushed downwardly to return to the closed position of FIG. 7. The cammed edge 56 of flange 34 pushes the lower end 50 of the actuator means 42 out of the way. The stem 48 will then snap back into position when the bottom 50 of strut 48 moves above the flange 34. The valve 30 will then again be locked in the closed position.

When the bottom 50 of the strut 48 is disengaged from the flange 34 by pivoting of the button 44, the spring 54 causes the valve to open. The pair of flanges 34 of the valve 30 will engage the first bottom rim portion 22 of the openings 19, 20 in the well as indicated in FIG. 8. This will keep the valve 30 from popping out of the closure. The pair of flanges 34 therefore move in the openings 19,20 during opening and closing of the valve 30.

In FIG. 8, a portion of the valve 30 extends above the top surface 13 of cap 11. This portion of the valve can serve as a spout if so desired. A consumer can put this extended portion into his or her mouth and drink directly from the container. Also, the relatively flat smooth lid 38 avoids sharp edges around the discharge opening. Therefore, the potential to cut a consumer's fingers or lips can be reduced.

As indicated in FIG. 7, the valve reciprocates linearly along longitudinal axis 56. This longitudinal axis passes through the centrally disposed pin 26 and along the longitudinal axes of the well 15 and valve sleeve 32. The well and the valve sleeve have generally coincident longitudinal axes which are generally coextensive with the longitudinal axis 56. The inclined strut 48, on the other hand, has a longitudinal axis 58 as noted above. This longitudinal axis 58 is nonparallel and nonperpendicular to the longitudinal axis 56.

In operation, the valve 30 will normally be in the closed position shown in FIG. 7. A consumer can then push button 44 with his or her finger in order to cause valve 30 to automatically open as shown in FIG. 8. The spring 54 of the opening means 52 automatically moves the valve from the closed position to the popped-up open position in response to unlocking of the valve by the actuation means 42. Finger pressure can simply tilt the button 44 to open the valve 30. Fluid within container 12 can then easily be discharged. The pop-up valve closure 10 of the present invention is easily resealable, automatically openable and easy to use. Sharp edges around the discharge aperture 40 are avoided and an upper portion of the valve can actually be used as a drinking spout.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A pop-up valve closure for a container comprising:

a cap having a well defined therein;

a valve having a sleeve and an outlet, the valve being movably mounted in the well of the cap between a closed position and a popped-up open position, a flow path extending between an interior of the container to the outlet, the valve closing the flow path in the closed position and providing uninterrupted, open access to the interior of the container via said flow path in the open position, said flow path in the closed position being open downstream of the outlet;

actuation means for locking and unlocking the valve in the closed position, the actuation means being mounted on the cap; and opening means for automatically moving the valve from the closed position to the popped-up open position in response to depression of the actuation means by a finger of a user to thereby unlock the valve.

2. The pop-up valve closure as recited in claim 1, wherein the actuation means comprises a button pivotally mounted on the cap and a strut extending from the button, the valve sleeve having a flange engageable with the strut, depression of the button pivoting the button to move the strut to disengage from the flange of the valve sleeve.

3. The pop-up valve closure as recited in claim 2, wherein the opening means comprises a spring mounted within the valve sleeve, the spring urges the valve to the open position, the valve being held in the closed position by engagement of the strut with the flange and being released from the closed position upon pivoting of the bottom to release the strut from the flange whereupon the spring moves the valve to the open position.

4. The pop-up valve closure as recited in claim 3, wherein the valve has a lid at an upper end of the sleeve and the well of the cap has a cross member mounted therein, a centrally disposed pin being mounted on the cross member, the well being open at both an upper end and a lower end, the cross member extending across the lower end of the well and a lower end of the spring engaging the cross member and surrounding the pin mounted on the cross member, an upper end of the spring engaging an inner side of the lid of the valve.

5. The pop-up valve closure as recited in claim 4, further comprising a closure element mounted at the top of the pin, the lid of the valve having an aperture defined therein, the aperture in the lid being closed by the closure element when the valve is in the closed position and the lid of the valve moves away from the closure element when the valve moves to the open position such that the aperture in the lid is out of engagement with the closure element and is open whereby fluid is dischargeable from the container.

6. The pop-up valve closure as recited in claim 5, wherein the valve is linearly reciprocable between the closed position and the open position along a longitudinal axis, the longitudinal axis passing through the centrally disposed pin and wherein the strut has a longitudinal axis, the longitudinal axis of the strut being nonparallel and nonperpendicular to the longitudinal axis along which the valve reciprocates.

7. The pop-up valve closure as recited in claim 6, wherein a plurality of flanges are provided as the flange on the valve sleeve, at least one of the flanges being engaged by a bottom of the strut when the valve is in the closed position and wherein the flanges are engaged by bottom rim portions of the well when the valve is in the open position.

8. The pop-up valve closure as recited in claim 7, wherein openings are defined at a lower end of the well, a bottom periphery of the well being stepped to form the openings in the lower end of the well, the bottom rim portions of the well which are engaged by the flanges being tops of the openings in the lower end of the well, the flanges of the valve sleeve moving in the openings in the lower end of the well as the valve moves between the closed and open positions.

9. The pop-up valve closure as recited in claim 2, wherein the strut is inclined and extends from the button toward the well, a lower end of the strut being movable toward and away from the valve sleeve in the well upon pivoting of the button.

10. The pop-up valve closure as recited in claim 1, wherein the opening means comprises a spring mounted within the valve sleeve, the spring urges the valve to the open position.

11. The pop-up valve closure as recited in claim 1, wherein the valve has a lid at an upper end of the sleeve and the well of the cap has a cross member mounted therein, a centrally disposed pin being mounted on the cross member, the well being open at both an upper end and a lower end, the cross member extending across the lower end of the well and the opening means engaging the cross member and surrounding the pin mounted on the cross member, an upper end of the opening means engaging an inner side of the lid of the valve.

12. The pop-up valve closure as recited in claim 11, further comprising a closure element mounted at the top of the pin, the lid of the valve having an aperture defined therein, the aperture in the lid being closed by the closure element when the valve is in the closed position and the lid of the valve moves away from the closure element when the valve moves to the open position such that the aperture in the lid is out of engagement with the closure element and is open whereby fluid is dischargeable from the container.

13. The pop-up valve closure as recited in claim 11, wherein the valve is linearly reciprocable between the closed position and the open position along a longitudinal axis, the longitudinal axis passing through the centrally disposed pin.

14. The pop-up valve closure as recited in claim 1, further comprising a plurality of flanges on the valve sleeve, at least one of the flanges being engaged by the actuation means when the valve is in the closed position and wherein the flanges are engaged by bottom rim portions of the well when the valve is in the open position.

15. The pop-up valve closure as recited in claim 14, wherein openings are defined at a lower end of the well, a bottom periphery of the well being stepped to form the openings in the lower end of the well, the bottom rim portions of the well which are engaged by the flanges being tops of the openings in the lower end of the well, the flanges of the valve sleeve moving in the openings in the lower end of the well as the valve moves between the closed and open positions.

16. The pop-up valve closure as recited in claim 1, wherein the well and the valve sleeve are generally cylindrical and have generally coextensive longitudinal axes and wherein the valve has a lid at an upper end of the sleeve, the lid of the valve having an aperture defined therein, the aperture being intersected by the longitudinal axes of the well and valve sleeve, and the valve being linearly reciprocable between the closed position and the open position along the longitudinal axes.

17. The pop-up valve closure as recited in claim 1, wherein the cap has a top surface and an inclined surface, the well being mounted in the top surface of the cap and the actuation means being mounted on the inclined surface of the cap, the inclined surface adjoins the top surface of the cap.

18. The pop-up valve closure as recited in claim 1, wherein the sleeve has a longitudinal axis and the container has a longitudinal axis, the longitudinal axis of the sleeve being generally parallel to the longitudinal axis of the container.

19. The pop-up valve closure as recited in claim 1, wherein the valve has a lid at an upper end thereof, the lid having a discharge aperture therein, and the lid of the valve and the discharge aperture being generally flush with a surrounding portion of the top surface of the cap when the valve is in the closed position.

20. A pop-up valve closure for a container comprising:

a cap having a well defined therein;

a valve having a sleeve, the valve being movably mounted in the well of the cap between a closed position and a popped-up open position;

actuation means for locking and unlocking the valve in the closed position, the actuation means being mounted on the cap; and opening means for automatically moving the valve from the closed position to the popped-up open position in response to depression of the actuation means by a finger of a user to thereby unlock the valve, the actuation means includes a button pivotally mounted on the cap and a strut extending from the button, the valve sleeve having a flange engageable with the strut, depression of the button pivoting the button to move the strut to disengage from the flange of the valve sleeve.

21. The pop-up valve closure as recited in claim 20, wherein the opening means comprises a spring mounted within the valve sleeve, the spring urges the valve to the open position, the valve being held in the closed position by engagement of the strut with the flange and being released from the closed position upon pivoting of the bottom to release the strut from the flange whereupon the spring moves the valve to the open position.

22. The pop-up valve closure as recited in claim 21, wherein the valve has a lid at an upper end of the sleeve and the well of the cap has a cross member mounted therein, a centrally disposed pin being mounted on the cross member, the well being open at both an upper end and a lower end, the cross member extending across the lower end of the well and a lower end of the spring engaging the cross member and surrounding the pin mounted on the cross member, an upper end of the spring engaging an inner side of the lid of the valve.

23. The pop-up valve closure as recited in claim 22, further comprising a closure element mounted at the top of the pin, the lid of the valve having an aperture defined therein, the aperture in the lid being closed by the closure element when the valve is in the closed position and the lid of the valve moves away from the closure element when the valve moves to the open position such that the aperture in the lid is out of engagement with the closure element and is open whereby fluid is dischargeable from the container.

24. The pop-up valve closure as recited in claim 23, wherein the valve is linearly reciprocable between the closed position and the open position along a longitudinal axis, the longitudinal axis passing through the centrally disposed pin and wherein the strut has a longitudinal axis, the longitudinal axis of the strut being nonparallel and nonperpendicular to the longitudinal axis along which the valve reciprocates.

25. The pop-up valve closure as recited in claim 24, wherein a plurality of flanges are provided as the flange on the valve sleeve, at least one of the flanges being engaged by a bottom of the strut when the valve is in the closed position and wherein the flanges are engaged by bottom rim portions of the well when the valve is in the open position.

26. The pop-up valve closure as recited in claim 25, wherein openings are defined at a lower end of the well, a bottom periphery of the well being stepped to form the openings in the lower end of the well, the bottom rim portions of the well which are engaged by the flanges being tops of the openings in the lower end of the well, the flanges of the valve sleeve moving in the openings in the lower end of the well as the valve moves between the closed and open positions.

27. The pop-up valve closure as recited in claim 20, wherein the strut is inclined and extends from the button toward the well, a lower end of the strut being movable toward and away from the valve sleeve in the well upon pivoting of the button.

28. The pop-up valve closure as recited in claim 20, wherein the sleeve has a longitudinal axis and the container has a longitudinal axis, the longitudinal axis of the sleeve being generally parallel to the longitudinal axis of the container.

29. The pop-up valve closure as recited in claim 20, wherein the valve has a lid at an upper end thereof, the lid having a discharge aperture therein, and the lid of the valve and the discharge aperture being generally flush with a surrounding portion of the top surface of the cap when the valve is in the closed position.

* * * * *